United States Patent [19]

Hardy et al.

[11] 4,294,711

[45] Oct. 13, 1981

[54] WASHING AND SOFTENING COMPOSITIONS AND METHODS FOR THEIR MANUFACTURE

[75] Inventors: Frederick E. Hardy, Gosforth; Barry Stoddart, Gateshead, both of England

[73] Assignee: The Procter & Gamble Company, Cincinnati, Ohio

[21] Appl. No.: 187,371

[22] Filed: Sep. 15, 1980

[30] Foreign Application Priority Data

Sep. 21, 1979 [GB] United Kingdom ..... 32918/79

[51] Int. Cl.[3] ..... C11D 3/42; C11D 11/00; C11D 11/02; D06M 13/44

[52] U.S. Cl. ..... 252/8.75; 252/8.8; 252/91; 252/110; 252/117; 252/174; 252/174.13; 252/301.23; 252/524; 252/528; 252/543; 252/547; 427/220

[58] Field of Search ..... 252/8.75, 8.8, 90, 91, 252/174, 174.13, 301.23, 110, 117, 524, 528, 543, 547; 427/220

[56] References Cited

U.S. PATENT DOCUMENTS

| | | | |
|---|---|---|---|
| 3,360,470 | 12/1967 | Wixon | 252/99 |
| 3,591,405 | 7/1971 | McCarty | 252/8.8 R |
| 3,895,009 | 7/1975 | Fringeli | 252/543 |
| 4,216,111 | 8/1980 | Thompson | 252/301.23 |

FOREIGN PATENT DOCUMENTS

| | | |
|---|---|---|
| 2372894 | 6/1978 | France . |
| 967110 | 8/1964 | United Kingdom . |
| 1053388 | 12/1966 | United Kingdom . |
| 1067723 | 5/1967 | United Kingdom . |
| 1079388 | 8/1967 | United Kingdom . |
| 1210952 | 11/1970 | United Kingdom . |
| 1301429 | 8/1972 | United Kingdom . |
| 1366905 | 9/1974 | United Kingdom . |
| 1173806 | 12/1979 | United Kingdom . |

OTHER PUBLICATIONS

Stensby, Per. S. "Optical Brighteners in Fabric Softeners", *Soap & Chemical Specialties,* May 1965, pp. 85–88.

*Primary Examiner*—Dennis L. Albrecht

[57] ABSTRACT

Granular built detergent compositions having good textile softening and cleaning properties comprise a nonionic surfactant, a cationic textile softening agent, a detergent builder and an optical brightener of the 4,4'bis (triazinylamino) stilbene 2,2' sulphonic acid type in a zwitterionic form having a low rate of solution in an aqueous medium of pH 9 at 25° C.

9 Claims, No Drawings

WASHING AND SOFTENING COMPOSITIONS AND METHODS FOR THEIR MANUFACTURE

The present invention relates to granular built detergent compositions which have very good cleaning properties and also textile softening properties.

For many years most heavy duty, built, detergent compositions have been based upon anionic surfactants and they have been observed to cause some harshness in the feel of washed fabrics. Accordingly there have been developed textile softening compositions, and these have been based upon long chained cationic surfactants. As cationic and anionic surfactants are generally incompatible, these softening compositions have been intended for use in the final rinse of a washing process, that is, after substantially all the anionic surfactant has been removed. Clearly there is a need for a single composition able both to clean the fabrics and to soften them.

Attempts to incorporate cationic softeners in anionic based detergent compositions, overcoming their ordinary incompatibility, have been described in the art. Another approach has been to use nonionic surfactants with cationic softeners in built detergent compositions, as described in B.P. No. 1,079,388, DTAS No. 1,220,956 and U.S. Pat. No. 3,607,763. However, products containing a high ratio of nonionic detergent to cationic softener are said to soften inadequately, whereas those with a high ratio of cationic to nonionic are said to clean inadequately. A particular problem in the use of such products has been the discolouration, usually yellowing, of repeatedly washed fabrics.

This problem is believed to arise from three causes. The first is the ineffectiveness of most of the usual optical brighteners when applied in the presence of cationic surfactants due to the failure of the brightener to deposit upon fabrics in such surroundings and/or from an actual quenching of the fluorescence of the brightener in the presence of cationic surfactant. The second main cause of yellowing is build-up of the brightener itself, which in some circumstances can act as a dyestuff at visible wavelengths. The third cause is apparently an interaction between the cationic or nonionic-cationic surfactants and colouring matter in the water used to make up the wash baths. The extent of this problem depends upon the state of the civic water supply, and can vary from place to place and from time to time. Iron content may be one relevant factor but probably organic e.g. peaty colouring matter is more usually the principal cause.

In our Published European patent application No. 0006271 the first of these cases is addressed by the selection of specific nonionic brighteners that deposit on fabrics in the presence of, and are unquenched by, cationic surfactants. However, even these brighteners do not provide the level of fluorescence on fabrics that can be achieved with existing anionic surfactant-based heavy duty detergents that contain conventional anionic brighteners. Furthermore their introduction and use on a large scale would also be dependent on the generation of a significant body of data demonstrating adequate human and environmental safety. This is likely to be both time consuming and expensive.

It has now surprisingly been discovered that certain commercially available anionic optical brighteners, that exist in the insoluble zwitterionic form when acidified, can be maintained in this form under the conditions encountered during storage and use of alkaline built detergent compositions. Although the mechanism of the effect is not clearly understood, it is believed that normal anionic optical brighteners modify, perhaps by reaction with, cationic surfactant materials in the detergent solution and inhibit e.g. the deposition of cationic softener particles on the fabric. Thus whilst some decrease in optical whitening is observed as a result of this reaction, the principal effect is a decrease in fabric softness. The uncharged nature of certain such brighteners in a zwitterionic form, together with their insolubility in aqueous alkaline media makes them unreactive towards cationic surfactant materials, especially cationic softener particles, without affecting their ability to deposit on fabrics during the washing process. This discovery was unexpected in that it was believed that anionic brighteners in a zwitterionic form would revert almost instantaneously to the fully ionised form when exposed to the alkaline conditions under which conventional granular detergents are manufactured and stored, and would thereupon react with the cationic surfactant.

In its broadest aspect, therefore, the invention provides a detergent composition which comprises:

(a) from 3 to 30% by weight of one or more polyethoxy nonionic detergents having a hydrophilic-lipophilic balance in the range from 8 to 15 and having not more than an average of 16 ethoxy units per molecule;

(b) from 1 to 15% by weight of one or more cationic surfactant materials;

(c) from 10 to 80% by weight of a detergency builder; and (d) from 0.001 to 3% by weight of an acid optical brightener of the following structure:

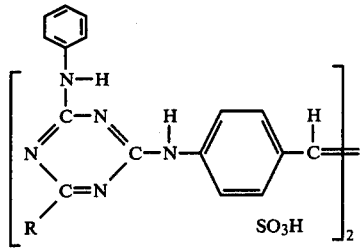

wherein R is a nitrogen-containing group capable of assuming a positive charge at a pH $<7$, thereby forming a zwitterion, the zwitterionic form of the brightener having a half neutralisation time, as hereinafter defined, of $>10$ minutes. In preferred embodiments of the invention R is

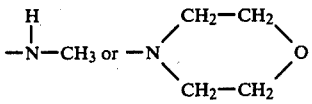

According to another aspect of the invention there is provided a method of making a detergent composition of the type described above comprising the steps of (i) preparing spray dried carrier granules comprising at least part of the builder component (c)

(ii) preparing a fluid mixture of components (a) (b) and (d), and (iii) spraying said fluid mixture on to a moving bed of said carrier granules.

DETAILED DESCRIPTION OF THE INVENTION

The Nonionic Detergent

Water-soluble nonionic synthetic detergents constitute the principal detergent component of the present compositions. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Examples of suitable nonionic detergents include: 1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 16 moles of ethylene oxide per mole of alkyl phenol. The alkyl substituent in such compounds may be derived, for example, from polymerised propylene, di-isobutylene, octene or nonene. Other examples include dodecylphenol condensed with 12 moles of ethylene oxide per mole of phenol; dinonylphenol condensed with 15 moles of ethylene oxide per mole of phenol; nonylphenol condensed with 9 moles of ethylene oxide per mole of nonylphenol and di-isooctylphenol condensed with 15 moles of ethylene oxide. 2. The condensation product of primary or secondary aliphatic alcohols having from 8 to 20 carbon atoms, in either straight chain or branched chain configuration, with from 1 to about 16 moles of alkylene oxide per mole of alcohol. Preferably, the aliphatic alcohol comprises between 9 and 15 carbon atoms and is ethoxylated with between 2 and 12, desirably between 3 and 8 moles of ethylene oxide per mole of aliphatic alcohol. Such nonionic surfactants are preferred from the point of view of providing good to excellent detergency performance on fatty and greasy soils. The preferred surfactants are prepared from primary alcohols which are either linear (such as those derived from natural fats or prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold, under the Trade Name Lial, by Liquichimica. Specific examples of nonionic surfactants falling within the scope of the invention include Dobanol 45-4, Dobanol 45-7, Dobanol 45-11, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 20 carbon atoms. Secondary linear alkyl ethoxylates are also suitable in the present compositions, especially those ethoxylates of the Tergitol series having from about 9 to 16 carbon atoms in the alkyl group and up to about 11, especially from about 3 to 9, ethoxy residues per molecule. (Tergitol is a trade name of Union Carbide Corp.) 3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Preferred nonionic detergents are coconut alcohol with 6 ethoxy residues per molecule, and Dobanol 45-7 (Trade Name for $C_{14-15}$ primary alcohols with 7 ethoxy residues per molecule).

Preferably the nonionic detergent comprises from 5 to 20% by weight of the composition.

The Cationic Surfactant Material

Any nitrogenous cationic surfactant material may be used in the compositions of the invention, such material being defined for the purposes of the present invention as containing at least one $C_{10}$ hydrocarbyl group attached to the nitrogen atom preferably in the form of an alkyl or alkenyl chain, and a hydrophilic anionic group. In a preferred form of the invention the cationic surfactant material is a cationic softener.

Among suitable cationic softeners are the conventional substantially water-insoluble quaternary ammonium compounds, and $C_{10-25}$ alkyl imidazolinium salts.

Well-known species of substantially waterinsoluble quaternary ammonium compounds have the formula:

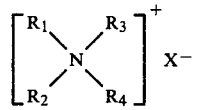

wherein $R_1$ and $R_2$ represent hydrocarbyl groups of from about 10 to about 22 carbon atoms; $R_3$ and $R_4$ represent hydrocarbyl groups containing from 1 to about 4 carbon atoms, X is any anion such as halide, a $C_2$–$C_{22}$ carboxylate, or an alkyl-or arylsulf(on)ate. Examples of preferred anions include bromide, chloride, methyl sulfate, toluene-, xylene-, cumene-, and benzenesulfonate, benzoate, p-hydroxybenzoate, acetate and, propionate. Preferred quaternary ammonium softeners are the di($C_{16}$–$C_{20}$ alkyl)di($C_1$–$C_4$ alkyl) ammonium salts such as ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; dieocosyl ammonium chloride; di(hydrogenated tallow) dimethyl ammonium methyl sulphate; dihexadecyl diethyl ammonium chloride; di(-coconutalkyl) dimethyl ammonium chloride. Ditallow dimethyl ammonium chloride, di(hydrogenated tallow-alkyl) dimethyl ammonium chloride and di-(coconutalkyl) dimethyl ammonium chloride are preferred. Also suitable are the single long chained quaternary ammonium compounds of the above formula wherein $R_1$ is $C_{10}$ to $C_{22}$ alkyl or alkenyl, preferably $C_{16}$ to $C_{20}$ alkyl, and $R_2$, $R_3$ and $R_4$ are lower alkyl groups, that is $C_1$ to $C_4$ alkyl groups, especially methyl, or aryl groups and X is as defined above. Optionally also two or all three of $R_2$, $R_3$ and $R_4$ may together represent a heterocyclic ring. Some representative examples of such compounds are lauryl trimethyl ammonium bromide, lauryl dimethyl benzyl ammonium chloride, myristyl dimethyl ethyl ammonium bromide, cetyl trimethyl ammonium bromide, behenyl trimethyl ammonium methosulfate, oleyl methyl diethyl ammonium chloride, cetyl stearyl or oleyl pyridinium chloride, behenyl pyridinium bromide, stearyl methyl morpholinium chloride, stearyl or oleyl ethyl or propyl morpholinium chloride.

Yet other quaternary ammonium cationic surfactants which may be mentioned have the formula:

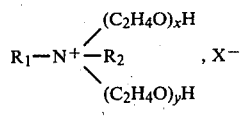

wherein $R_1$ and $R_2$ are as defined above or $R_2$ may be hydrogen and x and y are at least 1 and (x+y) is from 2 to 25. Examples are:

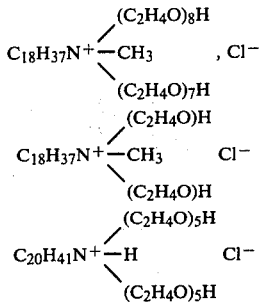

Substances of this sort are sold commercially, for instance under the Trade Name "Ethoquads".

Another class of suitable cationic surfactants can be represented by $C_{10-25}$alkylimidazolinium salts. Preferred salts are those conforming to the formula:

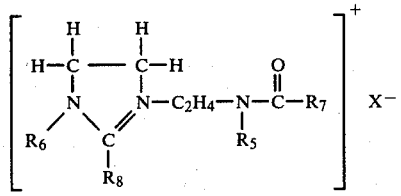

wherein $R_6$ is a $C_1$–$C_4$ alkyl radical, $R_5$ is hydrogen or a $C_1$–$C_4$ alkyl radical, $R_8$ is a $C_{10-25}$ alkyl radical and $R_7$ is hydrogen or a $C_{10-25}$ alkyl radical. X is a charge balancing ion which has the same meaning as X defined in the quaternary ammonium surfactant above.

A preferred member of this class, believed to be 1-methyl-2-tallowyl-3-(2-tallowamidoethyl-)imidazolinium chloride, is sold under the Trade Name Varisoft 455 or 475 (Ashland Chemical Company), or Steinoquat M5040/H (Chemische Werke Rewo).

Among other suitable cationic surfactants may be mentioned the substituted polyamine salts of general formula:

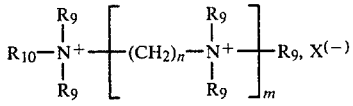

wherein $R_{10}$ is an alkyl or alkenyl group having from about 10 to 24, preferably 12 to 20, especially from 16 to 18 carbon atoms, the groups $R_9$ which may be the same or different, each represent hydrogen, a $(C_2H_4O)_pH$, or a $(C_3H_6O)_qH$, or a $C_{1-3}$ alkyl group wherein p and q may each be 0 or a number such that (p+q) does not exceed 25, n is an integer from 2 to 6, preferably 3, m is from about 1 to 9, preferably from 1 to 4, most preferably 1 or 2, and $X^{(-)}$ represents one or more anions having total charge balancing that of the nitrogen atoms.

Preferred compounds of this class are, most preferred, N-tallow-N,N',N'-trimethyl-1,3-propylene diamine dichloride or di-methosulphate, commercially available under the Trade Names Lilamine 540 EO-3 (Lilachem), Dinoramax SH3, Inopol ODX3 (Pierrefitte-Auby), and N-tallow-N,N,N',N',N'-pentamethyl-1,3-propylene diamine dichloride, commercially available under the Trade Names Stabiran MS-3 (Pierrefitte-Auby); Duoquad (Armour Hess); Adogen 477 (Ashland Company). Also suitable is the substance sold as Dinormac (Pierrefitte-Auby) or Duomac (Armour Hess) believed to have the formula:

$$\text{Tallowyl-N}^+\text{H}_2\text{—(CH}_2)_3\text{-N}^+\text{H}_3,\ 2(\text{OCOCH}_3)^-$$

or the corresponding chloride. Herein Tallowyl represents predominantly $C_{16}$ and $C_{18}$ alkyl groups derived from tallow fatty acids.

It is highly desirable when one or more of $R_9$ in these components is hydrogen, that the pH of the formulation be such that one or more of the nitrogen atoms is protonated.

Other suitable cationic softeners are described in U.S. Pat. No. 4,076,632 issued Feb. 28, 1978. Some suitable commercially available substances are marketed under the following Trade Names:

Sopa (Pierrefitte-Auby)
Sopapa (Pierrefitte-Auby)
Lilamin LS33 (Lilachim)
Polyram L 200 (Pierrefitte-Auby)
Taflon—320A (Diichi Kogyo Seiyaku Co.).

Mixtures of two or more of these cationic softeners may be employed.

Preferred cationic softeners are ditallowyl dimethyl ammonium halides or methosulphate, and imidazolinium salts e.g. Varisoft 455 or 475.

Preferably the compositions of the invention contain from 3 to 10% by weight of cationic surfactant material. It is preferred that the weight ratio of nonionic detergent to cationic surfactant material be in the range from 10:1 to 0.5:1, especially from 3:1 to 1:1.

The Detergency Builders

Suitable detergent builder salts useful herein can be of the polyvalent inorganic and polyvalent organic types, or mixture thereof. Non-limiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, pentapolyphosphates and hexametaphosphates.

Examples of suitable organic alkaline detergency builder salts are:

(1) water-soluble amino polyacetates, e.g., sodium and potassium ethylenediaminetetraacetates, nitrilotriacetates, N-2(2-hydroxyethyl)nitrilodiacetates and diethylenetriamine pentaacetates;

(2) water-soluble salts of phytic acid, e.g. sodium and potassium phytates;

(3) water-soluble polyphosphonates, including sodium, potassium and lithium salts of ethane-1-hydroxy-1,1-diphosphonic acid; sodium, potassium, and lithium salts of methylenediphosphonic acid and the like.

(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, cyclopentane-cis,cis,cis-tetracarboxylic acid, mellitic acid and pyromellitic acid.

Mixtures of organic and/or inorganic builders can be used herein. One such mixture of builders is disclosed in Canadian Pat. No. 755,038, e.g. a ternary mixture of sodium tripolyphosphate, trisodium nitrilotriacetate, and trisodium ethane-1-hydroxy-1,1-diphosphonate.

Another type of detergency builder material useful in the present compositions and processes comprises a water-soluble material capable of forming a water-insoluble reaction production with water hardness cations preferably in combination with a crystallization seed which is capable of providing growth sites for said reactions product. Such "seeded builder" compositions are fully disclosed in British Patent No. 1,424,406.

Preferred water soluble builders are sodium tripolyphosphate and sodium silicate, and usually both are present. In particular it is preferred that a substantial proportion, for instance from 3 to 15% by weight of the composition of sodium silicate (solids) of ratio (weight ratio $SiO_2$:$Na_2O$) from 1:1 to 3.5:1 be employed.

A further class of detergency builder materials useful in the present invention are insoluble sodium aluminosilicates, particularly those described in Belgian Pat. No. 814,874. This patent discloses and claims detergent compositions containing sodium aluminosilicates of the formula $$Na_z(AlO_2)_z(SiO_2)_yXH_2O$$

wherein z and y are integers equal to at least 6, the molar ratio of z to y is in the range of from 1.0:1 to about 0.5:1 and X is an integer from about 15 to about 264, said aluminosilicates having a calcium ion exchange capacity of at least 200 mg.eq./gram and a calcium ion exchange rate of at least about 2 grains/minute/gram. A preferred material is $Na_{12}(SiO_2AlO_2)_{12}27H_2O$.

The Optical Brightener

Optical brighteners found useful in the compositions of the present invention are 4,4'bis(triazinylamino)stilbene 2,2'sulphonic acid derivatives of formula:

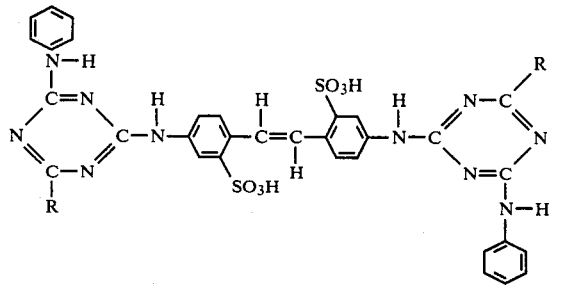

wherein R is a group containing a nitrogen atom capable of assuming a positive charge in aqueous media of pH <7 so as to form a zwitterion, the zwitterionic form of the brightener having a half neutralisation time ($t_{n/2}$)>10 minutes in the test defined below.

Preferred R groups for the purposes of the invention are (a)

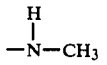

and (b)

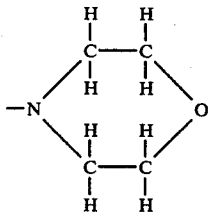

An optical brightener believed to have the structure (a) is available from Bayer AG under the trade name Blankophor RKH 766 pure. The anionic (fully neutralised) form of the brightener believed to have the structure (b) is available from Bayer AG under the trade name Blankophor MBBH and from Ciba Geigy AG under the trade name Tinopal DMS-X.

Neutralisation Test

This test uses an automatic titrator provided with means for maintaining the pH of a sample at a constant value (pH 9) and a constant temperature (40° C.). The optical brighteners were tested in the zwitterionic (acidified) form, free of additives such as dispersants and fillers, and were comminuted, if necessary, to give a particle size of $\leqq 10\mu$. Particle size was estimated by optical microscopy using Martin's diameter as the principal particle dimension. Martin's diameter is the dimension, parallel to the ocular scale, that divides the randomly oriented particle into two equal projected areas.

The particular instrument used for the test was a Radiometer automatic titrator manufactured by Radiometer A/S of Copenhagen, Denmark, comprising a PHM 74 meter, an REA 160 Titrigraph module, an RE61 Flat bed recorder and an ABU 13 autoburette assembly fitted with a 2.5 ml syringe.

Firstly the amount of standard NaOH solution required for complete neutralisation of 50 mg acid form brightener was determined. Then 500 ml of a 0.1 M solution of $Na_2SO_4$ in distilled water was adjusted to pH 9 with NaOH and the system allowed to reach thermal equilibrium at 40° C. in a closed beaker fitted with a thermostat. 50 mg of acid brightener having a mean particle size of $\leqq 10\mu$ was added to the beaker and dispersed using a magnetic stirrer to give a uniform dispersion. The apparatus was switched to its pH-stat mode with $N/_{50}$ NaOH in the syringe and the time for half neutralisation ($t_{n/2}$) at pH 9 and 40° C. noted from the titrigraph response.

Using this test, a fluorescer of the structure (a) and particle size $2.5\mu$ gave a $t_{n/2}$ of 26.2 minutes and a fluorescer of structure (b) and a similar particle size gave a $t_{n/2}$ of $\approx 30$ minutes. By comparison, a commercially available fluorescer, Blankophor BBH pure, believed to have an identical structure but with $R = -N(CH_2CH_2OH)_2$ gave a $t_{n/2}$ of $\approx 1.3$ minutes. As supplied, this fluorescer had a needle crystal form of $20\mu$ length and $2.5\mu$ thickness and required ultrasonic treatment to reduce it to a mean size of $< 10\mu$. In its uncomminuted form its $t_{n/2}$ was 2 minutes.

The optical brighteners can be used at levels from 0.001% to 3% by weight of the formulation, generally at levels of from 0.005% to 1.0% and preferably from 0.01% to 0.5%. Any conventional incorporation technique can be used including addition to the ingredients to be mixed in the crutcher for spray drying. However it is highly preferred that the optical brighteners are not added to strongly alkaline crutcher mixes eg. those containing appreciable free alkalinity in the form of silicates or carbonates. A preferred method of incorporation is by spraying a slurry of the brightener optionally with the nonionic and/or cationic surfactants onto a moving bed of carrier granules formed of at least some of the detergent builder components of the formulation.

Optional Components

A preferred optional component of the present invention is a discolouration inhibitor comprising 0.3–5.0% of a material selected from (i) condensates of $C_{10}$ to $C_{20}$ monohydric alcohols with at least 17 molar proportions of ethylene oxide
(ii) polyethylene glycols of molecular weight from 1,000 to 30,000; and
(iii) polyvinyl alcohols of molecular weight from 10,000 to 20,000.

The most preferred agents for this purpose are higher ethoxylates of $C_{10}$–$C_{20}$ linear primary monohydric alcohols, i.e. those having at least 17 ethoxy groups per molecule on average. Especially preferred are ethoxylated tallow alcohols with from 20 to 100 ethoxy groups, especially 25 or 80 (conventionally abbreviated as $TAE_{25}$, $TAE_{80}$).

Preferred members of the other groups are polyethylene glycols of molecular weight from 6,000 to 20,000 and polyvinyl alcohols of molecular weight about 14,000. Ethoxylated sorbitan $C_{14}$–$C_{18}$ fatty acid esters containing 17 or more ethoxy groups per mole of ester have also been found to be effective.

These materials are used at a level of from 0.3% to 5%, preferably 0.5% to 3.0% by weight of the composition.

Certain other optional ingredients also provide inhibition of fabric discolouration. Included amongst these are soil suspending agents such as sodium carboxymethyl cellulose, preferably at a level from about 0.5% to 1.5% by weight of the compositions; and high MWt (10,000–250,000) copolymers of maleic anhydride with methyl vinyl ether or ethylene or the corresponding acids or alkali metal, e.g. sodium salts. A range of suitable materials is available from the GAF Corporation under the Gantrez Trade Mark and from BASF GmbH under the Sokolan Trade Mark.

Sequestering agents effective for chelating especially ferric iron, also function as agents to inhibit yellowing caused by iron in tap water. Examples include ethylene diamine tetraacetic acid, diethylene triamine penta acetic acid, ethylene diamine tetra methylene phosphonic acid, diethylene triamine pentamethylenephosphonic acid, hydroxyethane-1,1-diphosphonic acid and the alkali metal salts of such acids. Some of these eg. the amine methylene phosphonic acids, may also function as bleach stabilisers. Preferred agents are alkali metal diethylene triamine penta methylene phosphonate or ethylene diamine tetra methylene phosphonate salts, especially the sodium salts.

Very low levels (of the order of a few e.g. up to 100 parts per million) of blue or green dyestuffs can also be used, such as Polar Brilliant Blue, ultramarine blue, indigo violet or mixtures of tri and tetra sulphonated zinc phthalocyanine which serve to mask any residual yellowing caused by the compositions of the invention.

Other components useful in conventional built laundry detergents can additionally be included in compositions of the present invention, viz, (a) Bleaching agents such as sodium perborate, sodium percarbonate and other perhydrates, at levels from about 5% to 35% by weight of the composition, and activators therefor, such as tetra acetyl ethylene diamine, tetra acetyl glycouril and others known in the art, and stabilisers therefore, such as magnesium silicate.
(b) Suds controlling agents, such as mono or diethanolamides of fatty acids as suds stabilisers, and $C_{16-14}$ soaps or fatty acids, silicones, microcrystalline waxes and mixtures thereof as suds depressants.
(c) Nonionic brighteners, particularly the coumarin and benzoxazole derivatives such as are described in Published European Patent Application No. 0006271.
(d) Proteolytic, amylolytic or lipolytic enzymes, especially proteoloytic.
(e) Colours, non-substantive, and perfumes as required to improve the aesthetic acceptability of the products.

Throughout the description herein, where reference has been made to sodium salts, the use of potassium, lithium or ammonium or amine salts is possible instead if their extra cost etc., are justified for special reasons.

Making the Compositions

It has been found that it is important, in order to achieve the best possible softening performance from the preferred compositions of the invention, that the cationic softener be finely and intimately dispersed. Thus the cationic softener may be mixed in the form of fine solid particles with the rest of the composition, or it may be included in the crutcher mix which is spray dried to form the granules of the product. The nonionic detergent and optional ingredients such as the discolouration inhibitor may also be included in the crutcher mix. However it is much preferred that the zwitterionic optical brightener not be added to the crutcher mix because the concentrated alkaline conditions and high temperature are more likely to promote rapid reversion to the fully ionised form.

Accordingly the preferred method of manufacture for products of the present invention is to make carrier granules by spray drying a crutcher mix containing at least part, and usually substantially all, of the detergency builders and the other non-heat sensitive components, and then to spray on the remaining components including the optical brightener. In order to obtain carrier granules of desired density it is usually desirable to include a low level of anionic surfactant, especially sodium $C_{9-16}$ alkyl benzene sulphonate, in the carrier granules, as described in German Offenlegungschirft No. 2,617,956. However the amount of anionic surfactant should be less than the amount of nonionic surfactant in the compositions, and is usually from 0.1% to 5.0% by weight of the compositions, especially about 0.2% to 1.5%.

Thus an aqueous slurry is made up of the detergent builders (normally phosphate and silicate) filler salts, chelating agents, soil suspending agents and a low level of anionic surfactant, and this slurry is fed at 75° C. to 85° C. to the spray drying tower and dried to form carrier granules. A crutcher mix moisture in the range 25% to 40% by weight is normally used and spray drying tower inlet temperatures in the range 310° C. to 340° C. are employed to give a carrier granule having a moisture content in the range from 6% to 12% preferably from 8% to 10% by weight of the granule.

A molten mixture of the cationic softener, nonionic, surfactant and the optical brightener is prepared at 70°-90° C., atomised and applied as a fine spray to a moving bed of the carrier granules, in any suitable mixing equipment such as a pan granulator, a rotating drum or a fluidised bed.

Optional ingredients of the molten mixture include the discolouration inhibitor and the methyl vinyl ether-maleic acid copolymer, as well as other components if convenient. Either two fluid- or pressure-atomisation of the molten mixture can be employed, the latter being preferred. In the latter case a liquid mixture pressure of 4,800-7,000 kPa has been found to be suitable. It has been found to be advantageous to maintain the carrier granules, while they are being sprayed and/or afterwards at a temperature of above 35° C. especially about 40° C. to 75° C. for a period of about 1 to 5 minutes, whereby the free flowing properties of the composition are improved.

Heat sensitive solid, granular or powdery, components are dry mixed with the carrier granules either before or after spray on of the nonionic detergent-cationic softener mixture.

The invention is illustrated in the following Examples in which compositions are expressed in parts by weight unless otherwise stated.

EXAMPLE 1

Granular detergent compositions of the following compositions were evaluated for whiteness and softness impression:

| Composition (percent by weight) | A | B | C | D |
|---|---|---|---|---|
| (c) Ditallow dimethyl ammonium chloride | — | 6 | 6 | 4.5 |
| (c) Dobanol 45-7 (1) | — | 12 | 12 | 7.0 |
| (a) Sodium dodecylbenzene sulphonate | 5.5 | 1 | 1 | 1 |
| (a) Sodium tripolyphosphate | 36 | 33 | 33 | 33 |
| (a) Sodium silicate (2) | 5.0 | 4 | 4 | 4.2 |
| (a) Sodium sulphate | 7.5 | 18.5 | 18.5 | 15 |
| (d) Sodium perborate tetrahydrate | 25 | 25 | 25 | 25 |
| (a) Sodium carboxymethyl cellulose | 0.8 | 1.4 | 1.4 | 1.0 |
| (a) Ethylene diamine tetra methylene phosphonic acid sodium salt | — | 0.5 | 0.5 | 0.5 |
| (d) Enzyme | 0.6 | 1.3 | 1.3 | 0.4 |
| (a**) (c*) Optical Brightener (3) | 0.1** | 0.20* | 0.20** | 0.04* |
| (c) Tallow alcohol - $E_{80}$ (4) | 4 | 1 | 1 | 1 |
| (b) Dyestuff (5) | — | — | 0.002 | — |
| — Moisture and impurities | | Balance to 100 | | |

(1) $C_{14-15}$ primary alcohols condensed with 7 molar proportions of ethylene oxide.
(2) Ratio $SiO_2$:$Na_2O$ 2:1 by weight
(3) A 4,4'bis-(3-anilino-5-morpholino-triazinylamino)-stilbene-2,2'-disulphonic sodium salt B & C 4,4'bis-(3-anilino-5-methylamino-triazinylamino)-stilbene-2,2'-disulphonic acid. D 3-dimethyl-amino-7-methyl courmarin.
(4) Tallow alcohol condensed with 80 molar proportions of ethylene oxide. Type unknown for A.
(5) Irgalite CPV1 (Colour Index 51319).

Composition A was a commercially available heavy duty laundry detergent. Compositions B, C & D were prepared by making a slurry of components (a) with city water to give a crutcher mix moisture of 30-40% by weight, spray drying the crutcher mix to give granules having a moisture content of 10%, spraying these granules with a dispersion in water of the dye stuff (b), and then spraying them with a molten mixture of temperature 80° C. comprising components (c). In a preferred technique the flow properties of a portion of the product were enhanced by heating the granules after the two spray-on steps to from 37°-47° C. in a hot air fluidised bed, from 1 to 5 minutes. After cooling (if necessary) the granules were dry mixed with components (d) to form the finished product.

Washing Tests were carried out using products A-D and, in an additional Test, with product A to which a commercial liquid fabric softener, containing 6% Ditallow dimethyl ammonium chloride, was added at the final rinse stage. This combination is designated as E below. Washing Conditions were as follows:

Machine Miele 436 automatic front loading washer
Cycle 10 min Prewash (ambient temperature) plus 60 min Mainwash (60° C.)
Load 6 lb lightly soiled mixed fabrics plus desized cotton terry towels
Product 100 g in Prewash 125 g in Mainwash 90 g fabric softener, where applicable.
Waterhardness 18° Ca:Mg ratio=3:1 (molar)

The fabrics were air dried and then graded by expert panellists both for whiteness impression and for softness impression using a paired comparison technique. The results are expressed below on a Scheffe scale.

| Product | Test 1 Whiteness Impression | Softness Impression |
|---|---|---|
| A | +1.90 | −2.00 |
| C | +1.00 | −1.06 |
| D | −2.12 | +0.62 |
| E | −0.78 | 1.93 |
| | $^{d}0.95 = 0.58$ | $^{d}0.95 = 0.66$ |

| Product | Test 2 Whiteness Impression | Softness Impression |
|---|---|---|
| A | +1.79 | −2.09 |
| B | +0.00 | +0.37 |
| D | −1.62 | +0.18 |
| E | −0.17 | +1.53 |
| | $^{d}0.95 = 0.79$ | $^{d}0.95 = 0.97$ |

From the results it can be seen that, in both Tests, the benchmark Product A (conventional detergent) has good whiteness impression but poor softness and that the addition of a conventional fabric softener to the rinse stage (E) produces the expected increase in softness impression but at the expense of whiteness (yellowing). Product D, a washing and softening detergent containing a nonionic optical whitening agent, in accordance with our published European Patent Application No. 0006271 provides enhanced softness but the whiteness impression relative to conventional products is inferior. The use of higher levels of nonionic brightener to make up this deficiency results in a yellow hue. Product C, in which a composition of the present invention is made by incorporating the zwitterionic control brightener in the crutcher mix prior to spray drying, gives good whiteness impression but indifferent softening. This is believed to be associated with the partial reversion of the brightener to the anionic form during processing and its subsequent interaction with the softener during the wash, thereby inhibiting softener deposition. Similar, but more pronounced inhibition of softening effect occurs if anionic brighteners are incorporated into the products of the present invention. Product B, made by incorporating the brightener into the nonionic spray-on applied to the base granules demonstrates that acceptable whiteness and softness benefits can be obtained from one product relative to the benefits obtainable when two conventional products are used together (treatment E).

In a similar test to Test 2 above, the effect of organic and iron salt contamination of the water supply was eliminated by using purified water for the production of the granules. This resulted in an enhancement of the whiteness impression of both products B+D relative to product A and to the treatment combination E.

EXAMPLE II

A granular detergent composition was prepared by a similar method to that described for product B in Example I having the following composition, in percent by weight.

| Composition | I |
|---|---|
| Ditallow dimethyl ammonium chloride | 4.5 |
| Dobanol 45-7 (1) | 7.0 |
| Sodium dodecylbenzene sulphonate | 1 |
| Tallow alcohol $E_{80}$ (2) | 1 |
| Sodium tripolyphosphate | 33 |

-continued

| Composition | I |
|---|---|
| Sodium silicate (3) | 4.2 |
| Sodium sulphate | 15.0 |
| Sodium perborate tetrahydrate | 25 |
| Sodium carboxymethyl cellulose | 1.0 |
| Ethylene diamine tetra methylene phosphonic acid (sodium salt) | 0.5 |
| Ethylene diamine tetra acetic acid (sodium salt) | 0.5 |
| Optical Brightener (4) | 0.2 |
| Moisture and Impurities | Balance to 100 |

(1) $C_{14-15}$ primary alcohols condensed with 7 molar proportions of ethylene oxide.
(2) Tallow alcohol condensed with 80 molar proportions of ethylene oxide.
(3) Ratio by weight of $SiO_2$:$Na_2O$ 1.6:1
(4) 4,4'-bis(3-anilino-5-morpholino-triazinyl-amino)-stilbene-2,2'-disulphonic acid.

Terry towelling swatches washed in this composition were assessed to have similar whiteness and softness impression to those washed by composition B of Example 1.

EXAMPLE III

An effective textile washing and softening composition has the formula, in percent by weight:

| | |
|---|---|
| Coconut alcohol $E_6$ | 10 |
| Ditallow dimethyl ammonium chloride | 4 |
| Tallow soap | 1 |
| Sodium tripolyphosphate | 48 |
| Sodium silicate ($SiO_2$:$Na_2O$ 2:1) | 6 |
| Sodium sulphate | 18 |
| Sodium carboxymethyl cellulose | 0.7 |
| Gantrez AN119 (1) (Trade Name) | 0.7 |
| Polyethylene glycol (M.Wt. 6000) | 1.3 |
| Optical Brightener (2) | 0.25 |
| Perfume | 0.5 |
| Moisture and impurities | Balance to 100 |

(1) Trade name for the sodium salt of methyl vinyl ether maleic anhydride copolymer supplied by GAF.
(2) Mixture of 0.20 parts of the brightener used in Composition B of Example 1 and 0.05 parts of 1,2 bis(benzoxazol-2-yl) ethylene.

EXAMPLE IV

A detergent composition with pronounced textile softening properties and providing acceptable fabric whiteness has the formula, in percent by weight:

| | |
|---|---|
| Dobanol 45-7 | 10 |
| Ditallow dimethyl ammonium chloride | 9 |
| Sodium dodecylbenzene sulphonate | 1 |
| Sodium tripolyphosphate | 33 |
| Sodium silicate | 4 |
| Sodium sulphate | 18 |
| Sodium perborate tetrahydrate | 12 |
| Sodium carboxymethyl cellulose | 1 |
| Gantrez S95 (Trade Mark) | 1 |
| Enzyme containing granules | 1 |
| Optical Brightener of Example II | 0.2 |
| Tallow alcohol $E_{25}$ | 1 |
| Moisture and impurities | Balance to 100 |

EXAMPLE V

A textile softening heavy duty detergent has the following formula, in parts percent by weight:

| | |
|---|---|
| Dobanol 23-6.5 | 20 |
| Ditallow dimethyl ammonium chloride | 3 |
| Sodium tripolyphosphate | 50 |
| Sodium silicate ($SiO_2NaO$ 1.6:1) | 4 |
| Sodium carboxymethyl cellulose | 0.7 |

-continued

| | |
|---|---|
| Gantrez S95 | 0.7 |
| Sodium sulphate | 13 |
| Tallow alcohol - $E_{80}$ | 1 |
| Optical Brightener of Composition B of Example 1 | 0.2 |
| Perfume | 0.2 |
| Moisture and Minors | Balance to 100 |

What we claim is:

1. A granular detergent composition adapted to impart a soft feel to fabrics washed therewith, consisting essentially of:

(a) from about 3% to about 30% by weight of a polyethoxy nonionic detergent having a hydrophilic-lipophilic balance in the range from about 8 to about 15 and having not more than an average of 16 ethoxy units per molecule;

(b) from about 1% to about 15% by weight of a cationic surfactant material;

(c) from about 10% to about 80% by weight of a detergency builder; and (d) from about 0.001% to about 3% by weight of an acid optical brightener of the following structure

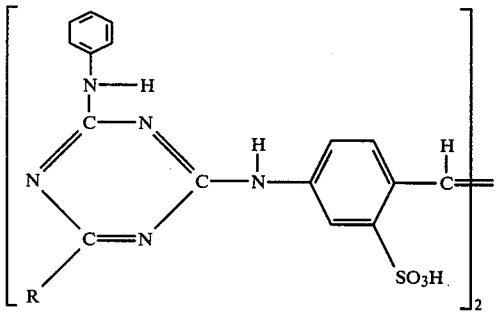

wherein R is selected from the group consisting of methylamino- and morpholino- groups.

2. A composition according to claim 1 consisting essentially of:

from about 5% to about 20% by weight of component (a)

from about 3% to about 10% by weight of component (b)

from about 20% to about 70% by weight of component (c)

and from about 0.01% to about 0.5% by weight of component (d).

3. A composition according to claim 1 wherein the cationic surfactant material (b) is selected from:

(a) non-cyclic quaternary ammonium salts having at least one $C_{12-30}$ alkyl chain in the molecule (b) $C_{10-25}$ alkyl imidazolinium salts (c) $C_{12-20}$ alkyl pyridinium salts (d) $C_{12-20}$ alkyl morpholinium salts (e) substituted polyamino salts of general formula

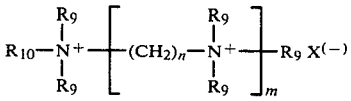

wherein $R_{10}$ is an alkyl or alkenyl group having 10 to 24 carbon atoms, the groups $R_9$ which may be the same or different each represent hydrogen, $-(C_2H_4O)_pH$, $(C_3H_6O)_qH$, or $C_{1-3}$ alkyl, where p and q may be a number such that (p+q) does not exceed 25, n is an integer from 2 to 6, m is from 1 to 9 and $X^{(-)}$ represents one or more anions having total charge balancing that of the nitrogen atoms.

(f) mixture of any of (a) to (e).

4. A composition according to claim 3 wherein the cationic surfactant material of component (b) is a cationic textile softener.

5. A composition according to claim 4 wherein the cationic softener is selected from di($C_{16}$-$C_{20}$ alkyl)-dimethyl ammonium salts, 1 methyl-2-tallowyl-3-(2-tallow amido ethyl)imidazolinium salts and mixtures thereof.

6. A compositon according to claim 4 wherein the weight ratio of nonionic detergent to cationic surfactant material is in the range from about 10:1 to about 0.5:1.

7. A composition according to claim 1 wherein the nonionic detergents are selected from condensates of monohydric branched or unbranched primary or secondary alcohols having from about 8 to about 20 carbon atoms, and condensates of alkyl phenols having from about 6 to about 16 carbon atoms in the alkyl chain, each with from about 4 to about 16 molar proportions of ethylene oxide, and mixtures thereof.

8. A composition according to claim 7 wherein the nonionic detergents comprise condensates of branched or unbranched primary alcohols having from about 12 to about 18 carbon atoms condensed with from about 5 to about 11 molar proportions of ethylene oxide.

9. A composition according to claim 1 wherein the water soluble detergency builders are selected from the group consisting of water soluble, alkali metal carbonates, borates, phosphates, polyphosphates, bicarbonates, silicates and sulphates, amino polycarboxylates, phytates, phosphonates and amino methylene phosphonates, and mixtures thereof.

* * * * *